United States Patent [19]

Alibert

[11] Patent Number: 4,802,865

[45] Date of Patent: Feb. 7, 1989

[54] CABLE CONNECTOR ARRANGEMENT TO ACCOMMODATE AN ANGULAR CABLE LAYOUT

[76] Inventor: Vernon F. Alibert, Misty Hollow R.D.#3, Glen Mills, Pa. 19342

[21] Appl. No.: 34,007

[22] Filed: Apr. 2, 1987

[51] Int. Cl.[4] ..... H01R 13/59

[52] U.S. Cl. ..... 439/461

[58] Field of Search ..... 439/461, 535, 537, 905, 439/906

[56] References Cited

U.S. PATENT DOCUMENTS

| | | | |
|---|---|---|---|
| 1,314,346 | 8/1919 | Meschenmoser | 439/535 |
| 3,659,251 | 4/1972 | Fish | 439/906 X |
| 3,798,584 | 3/1979 | Person | 439/537 X |
| 4,358,079 | 11/1982 | Navarro | 439/461 |

*Primary Examiner*—Eugene F. Desmond

*Attorney, Agent, or Firm*—William E. Cleaver

[57] ABSTRACT

The present arrangement includes a central housing member which has a hollow chamber therein and which has at least two apertures passing from the outside wall into the internal hollow chamber. The apertures are disposed, or positioned, so that their axes are at an angle of less than 180° to each other and in a preferred embodiment are at right angles to each other. The walls of the apertures are formed to be connectable. In the preferred embodiment one of the aperture walls is threaded internally to accept an externally threaded cable connector piece while the other aperture wall is formed into an externally threaded protrusion thereby enabling an internally threaded cable connector piece to be threaded onto the externally threaded protrusion. The cable connector pieces are designed to be secured to a cable and thus the entire cable connector assembly is secured to a cable which cable is positioned to define a right angle (or other angle) path.

5 Claims, 1 Drawing Sheet

CABLE CONNECTOR ARRANGEMENT TO ACCOMMODATE AN ANGULAR CABLE LAYOUT

BACKGROUND OF THE DISCLOSURE

The use of cables for signal transmission paths is well understood in the communication art. The use of cable connectors for connecting such cables to circuit boards and the like is also well understood. The more miniaturized the communications systems have become, the more difficult it has become to keep the many wires of the cables secured to a connector device. In the prior art the many wires of the cable are connected to a connector by soldering of the wires of the cable to a plurality of solder pots. Solder pots are the ends of contacts which protrude from a receptacle holder. The connector normally has a housing which holds the receptacle holder and that housing is clamped to the cover of the cable in two principal ways. The first principal way is to crimp the ends of the housing to the cable cover and the friction of the "pushed in" section of the housing clamps the housing in position to the cable. An alternative practice in the prior art has been to use a cylindrical clamp which has screws passing orthogonally to the cable cover. As the screws are tightened or threaded inward the ring more firmly grasps the cable cover. In such prior art practices a special tool has been required in order to effect crimping and neither of the techniques prevents rotation of the receptacle holder within the housing nor do such techniques prevent axial movement of the receptacle holder within the housing. Accordingly, any strains on the cable connection per se are transmitted to the solder connections and can cause those connections to break in response to a twisting motion or in response to a pulling effort.

In my copending patent application entitled "Cable Connector Arrangement," Ser. No. 07/006,872, Plug Body For A Cable Connector Arrangement, Ser. No. 07/006,871, and Cable Connector Arrangement To Accommodate Multiple Cable Sizes, Ser No. 07/034,008, I have described improved devices for securing connector pieces to cables. While straight cable connections are improved by the structure taught in my above mentioned copending applications, there has been a need for securing cables which are laid out to follow an angular path. For instance, in high quality instrumentation, it is often the requirement that the cables enter the instrument box along a path which is at right angles to the electrical connections of the instrument per se. Heretofore such cable arrangements included a technique whereby the cables were connected or soldered within a box. Such a procedure is difficult and the end results are unsatisfactory in that the cable connections within the box are not protected from twists or tugs applied to the cable.

The present arrangement provides a simplified means for laying out a cable around a right angle (or other angle), for clamping an angular cable connector arrangement to a cable without requiring special tools and further provides a means for preventing both rotational and axial movement of the cable connections which are being held within a housing.

SUMMARY OF THE DISCLOSURE

In a preferred embodiment the present arrangement includes a rectangular central housing member. It should be understood that the central housing member could be other shapes than rectangular. In the preferred embodiment, from a first side of the central housing member there is formed an externally threaded protrusion. The externally threaded protrusion has an aperture therein which passes through the first side of the central housing member. It should be understood that the central housing member is substantially hollow inside. In a second side of the central housing member there is formed an internally threaded aperture and the second side is disposed so that the axis of the aperture therein is at a right angle to the axis of the aperture located in the externally threaded protrusion. The two apertures could be at angles greater than or less than 90°. The arrangement further includes a first connector clamping member which has an internally threaded section that matches the externally threaded protrusion of the first side. Accordingly, the first connector clamping member can be threaded onto the externally threaded protrusion. In a preferred embodiment, the first connecting clamp member includes a plurality of tines which extend from the end of the clamping member which lies away from the internally threaded section. The tines are serrated and are forced against and into a cable passing through the aperture of the externally threaded protrusion and through the aperture of the clamping member. It should be understood that a section of the first clamping member which lies between the internally threaded section and the beginning of the tines is externally threaded and that a compression nut is threaded thereon to cause the tines to be forced against the cable to provide a clamping effect thereon. It should be understood that the first connecting clamp member could provide a means for crimping the member to a cable passing therethrough. A second cable connecting member which can be formed either integral with the central housing member or can be formed to be threaded into the central housing member has an aperture therethrough to accommodate the cable. This second connecting member has an externally threaded section which matches the internally threaded aperture of the second wall of the central housing member. When the threaded section of the second cable connector is threaded into the threaded aperture of the second wall of the central housing member, there is an aperture formed through the second cable connector member into the hollow chamber of the central housing member. The second cable connecting member has a key protrusion disposed to lie internally and axially, as well as a second key protrusion which is disposed to lie internally and circumferentially. In addition the arrangement includes a plastic insert which holds a plurality of female receptacles. The female receptacles are open ended and flush with one end of the plastic insert, while such receptacles protrude from the other end of the plastic insert and form solder pots. The teflon insert has an axial keyway to match the axial key of the second clamping member and has a circumferential keyway to match the circumferential key of the second clamping member. When a cable is to be connected with the electrical connections of an instrument, for instance, the cable is first passed through the compression nut, thereafter through the first clamping member, thereafter through the central housing member making a right angle therein, and through the second connecting member. Thereafter the second connecting member is threaded into the central housing member and the first connector clamping member is threaded on to the externally threaded protrusion. Subsequently the many wires of the cable are soldered to the solder pots and then the cable is carefully pulled and the plastic insert is carefully pushed so that the teflon insert snaps into the cylindrical section of the second connecting member by having the axial keyway in the plastic insert fit with the axial key of the second connecting member and the circumferential keyway of the plastic insert being fitted with the circumferential key of the second connecting member. When the cable is so pulled and the insert so pushed there will be excess cable coming through the first clamping member and through the tines. Next the compression nut will be threaded onto the first clamping member thereby forcing the tines into the cable cover to make a solid coupling thereat. The electrical connections of the instrumentation can then be "plugged in" to the plastic insert and the cable will provide a right angle path from inside the central housing to the instrumentation. Accordingly any tugs or twists that are applied to the cable only cause a stress on the insert or on the tines and hence the soldered positions cannot be moved rotationally or axially. Accordingly the soldered joints are protected. The present connector assembly is clamped through the tines to the cable with only the pressure exerted by a human thumb and forefinger and at the same time the solder joints are protected and the cable has been laid out in an angular fashion.

The features and objects of the present invention will be better understood in accordance with the following description taken in conjunction with the drawings wherein.

Figure 1:
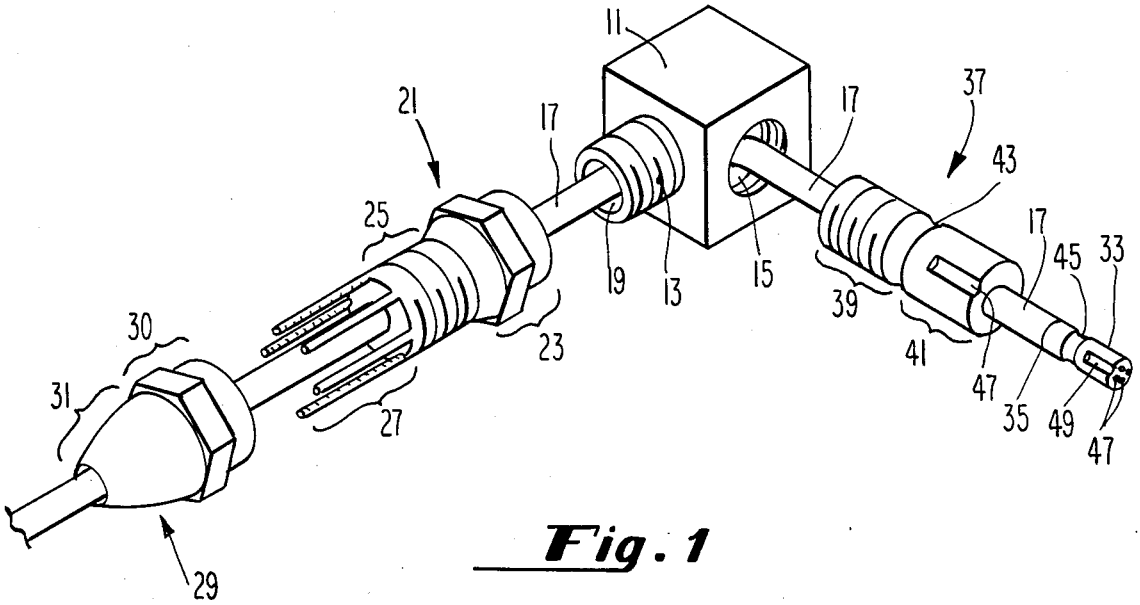
FIG. 1 is a pictorial view of the present invention.

Consider FIG. 1 wherein there is depicted a central housing block 11. The central housing block 11 is shown in a cubic square configuration although it should be understood that it could be in other configurations such as a hexagonal three dimensional configuration or a spherical configuration or other forms of rectangular three dimensional arrangements. The central block is fabricated from brass in the preferred embodiment although other forms of suitable materials could be used.

As can be seen in FIG. 1, there is formed integral with one side of the central housing block 11 an externally threaded protrusion 13. Also, as can be gleaned from FIG. 1, in a second side of the block 11 there is formed an internally threaded aperture 15. The inside of the block 11 is substantially hollow so that a cable, such as cable 17, can be passed through the aperture 15, into the central hollow section of the block 11, and through the aperture 19 of the externally threaded protrusion 13. It becomes apparent then from FIG. 1 that the cable 17 is formed into a right angle within the central housing block. It should be understood that since other shaped central blocks could be used that the angle path along which the cable passes through the central block could be some angle other than 90°.

As can be further seen in FIG. 1 there is a first cable clamping member 21 which has the cable 17 passing therethrough. The first clamping member 21 has an internally threaded section 23 and the pitch of the threads therein are formed to match the threads of the externally threaded protrusion 13. As can also be understood from examining FIG. 1 the first cable clamping member 21 has an externally threaded section 25 and a plurality of tines 27 extending therefrom. It should be noted in FIG. 1 that the cable 17 passes through the tines and through a compression nut 29. The compression nut 29 has an internally threaded section which matches and fits the threaded section 25. In addition the compression nut 29 has a tapered down section 31 so that when the compression nut is threaded onto the section 25, the tines are bent inward toward one another and come to bump into the cover of the cable 17. Accordingly the assembly of the members of the present arrangement is as follows: First the wires of the cable 17 are soldered to the receptacles 47. Then the cable connector member 37 is threaded into the aperture 15. Thereafter the cable 17 is gently pulled through the central housing block 11 and the plastic insert 33 is snapped into position in the cable connector member 37. The plastic insert 33 is snapped into the holder 41 by virtue of having the key 43 being fitted into the keyway 45 and further by virtue of having the key 47 being fitted into the keyway 49. When the insert 33 is snapped, or fitted, into the key holder 41, the cable 17 will have been fully drawn into the second connector member 37. Next the first clamping member 21 is threaded onto the protrusion 13 and tightened up simply by the pressure of the thumb and forefinger of a human being. As was mentioned above it is important to note that before the compression nut 29 is threaded on to the externally threaded section 25, the wires from the cable 17 should be soldered to the solder pots in the plastic insert 33 at the position 35. The plastic insert 33 has a plurality of female receptacles passing therethrough and which protrude therefrom at the position 35 and these protrusions are the solder pots. At the position 35 the wires from cable 17 are individually soldered into those female receptacles and hence the soldering joints are located at position 35. If we once again consider the assembly of the members it should be noted that the cable is pulled through the first clamping member 21 and simultaneously therewith the cable is pulled out of the central housing block 11. Thereafter the compression nut 29 is threaded onto the externally threaded section 25 which forces the tines 27 to grip or clamp into the cover of the cable 17. It follows then that the entire assembly shown in FIG. 1 is secured to the cable 17 and that the cable 17 has been laid out along a right angle and that the female receptacles 48 are ready to be plugged with the electrical connections of the instrumentation.

Figure 2:
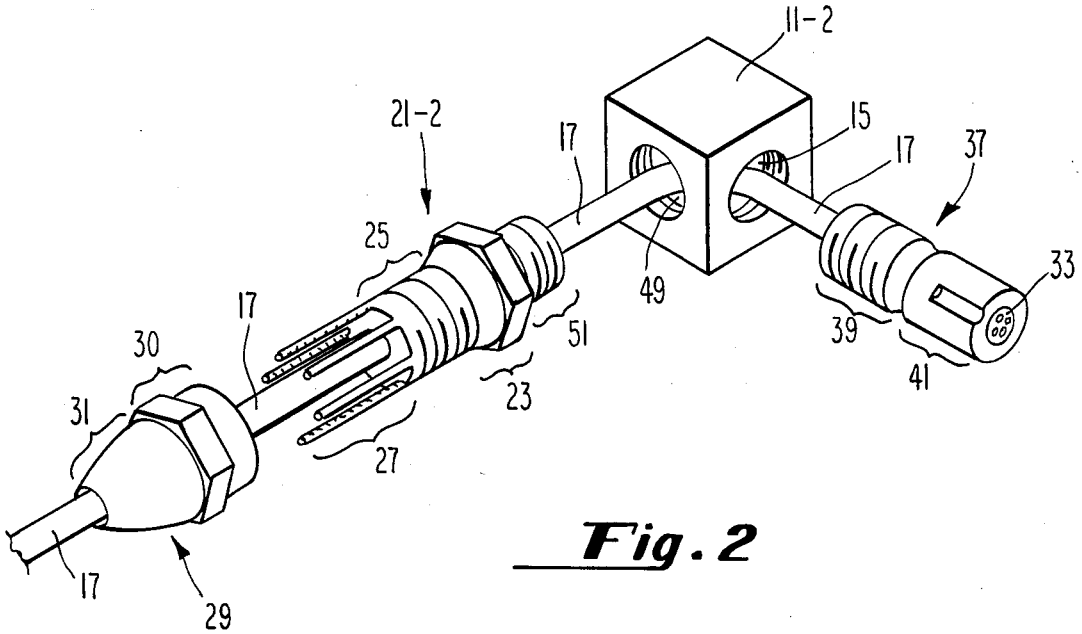
FIG. 2 shows a second embodiment of the present invention.

Consider FIG. 2. In FIG. 2 there is shown a central block 11-2 which is very similar to the block 11 of FIG. 1 excepting that in the block 11-2 there are two apertures 15 and 49 formed instead of having only one aperture along with an externally threaded protrusion as was the case in FIG. 1. The aperture 15 is labeled the same as the aperture 15 in FIG. 1 while the aperture 49 is in the position of the externally threaded protrusion 13. Note that each of the apertures 15 and 49 is internally threaded. With respect to the arrangement of FIG. 2 the second connecting member 37 would have its threaded section 39 threaded into the aperture 15 after the insert holder has been located in holder 41, even though the arrangement of FIG. 2 shows the plastic insert already snapped into the insert holder 41. Actually the insert 33 would not be snapped into the insert holder 41 prior to the threaded section 39 being threaded into the aperture 15 but is so shown in FIG. 2 to give some better understanding of the relationship between the insert 33 and the insert holder 41. As was described above, in the actual procedure the threaded section 39 would first be, threaded into the aperture 15. Thereafter the insert 33 would be gently pushed into the insert holder 41 while at the same time the cable 17 would be pulled through the block 11-2, through the clamping member 21, and then through the compression nut 29.

It should be noted that the clamping member 21-2 is different from the clamping member 21 of FIG. 1 in that there is an externally threaded section 51 formed integral with the section 23. Accordingly the clamping 21-2 is pushed along the cable 21 and threaded into the aperture 49. When the second connecting member 37 is securely fitted into the aperture 15 and the insert 33 is in position and the first clamping member 21-2 is threaded into the aperture 41, then the compression nut 29 will be threaded up onto the externally threaded section 25 and the tines 27 will be moved down to clamp the cable 17.

Figure 3:
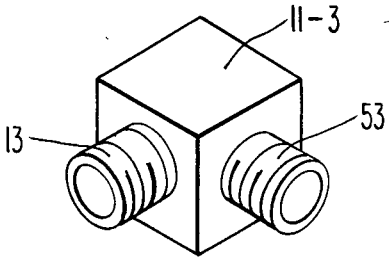
FIG. 3 depicts the central housing of a third embodiment of the present invention.

In FIG. 3 there is shown a third configuration of the center block which has been identified 11-3. Again the center block 11-3 is fabricated from brass in the preferred embodiment and there is a protrusion 13 on one side and a second protrusion 53 on the other. Each of the protrusions 13 and 15 have an aperture passing therethrough into the hollow center of the block 11-3. The first clamping member 21 shown in FIG. 1 would be threaded onto the protrusion 13 as was described in FIG. 1 and a second connecting member which has an internally threaded section would be threaded onto the protrusion 53. The remainder of the assembly would be similar to that already described and there appears to be no further reason to describe that procedure.

I claim:

1. A cable connector arrangement to accommodate an angular cable layout comprising in combination: housing means having a wall defining the outside thereof and being formed to have a substantially hollow chamber inside said housing means; said housing means having first and second wall sections formed to respectively define first and second apertures through said wall into said hollow chamber with the axis of said first aperture disposed to lie at an angle less than 180° from the axis of said second aperture; said first wall section and said second wall section further formed to be threaded in order to be respectively connectable to first and second cable connector means; first cable connector means formed to be threaded in order to be connected to said first wall section; said first cable connector means further formed to include a plurality of finger like structure means, each having a secured end formed integral with support means and disposed so that when viewed together said secured ends define an endless configuration, each of said finger like structure means having a free end with said free ends disposed so that a space is formed between each of said finger like structure means and any adjacent ones of said finger like structure means and wherein said first cable connector means further include a compression nut means having an aperture therethrough and formed to fit over said finger like structure means whereby when said compression nut means is moved over said finger like structure means they pass through said aperture in said compression nut to effect a clamping action on a cable passing through said finger like structure means and said compression nut; and second cable connector means formed to be threaded in order to be connectable to said second wall section and further formed to be secured to said cable whereby a cable can be passed through said first cable connector means and connected thereto, through said hollow chamber, and through said second cable means and connected thereto to form a cable layout which defines an angle of less than 180°.

2. A cable connector arrangement according to claim 1 wherein the axis of said first aperture is disposed to be 90° from the axis of said second aperture.

3. A cable connector arrangement according to claim 1 wherein said first wall section include an externally threaded protrusion and said second wall section is formed to be internally threaded.

4. A cable connector arrangement according to claim 1 wherein both said first and second wall sections are each formed to be internally threaded.

5. A cable connector arrangement according to claim 1 wherein both said first and second wall sections each further include an externally threaded protrusion.

* * * * *